US007229339B2

(12) United States Patent
Stumpf et al.

(10) Patent No.: US 7,229,339 B2
(45) Date of Patent: Jun. 12, 2007

(54) CMP APPARATUS AND METHOD

(75) Inventors: John F. Stumpf, Phoenix, AZ (US); Franklin D. Root, Phoenix, AZ (US); Brian Severson, Chandler, AZ (US); David Marquardt, Phoenix, AZ (US); John Derwood Herb, Phoenix, AZ (US); James Jed Crawford, Chandler, AZ (US); Rand Conner, Chandler, AZ (US); Jasent Montano, Chandler, AZ (US); Kevin Bertsch, Gilbert, AZ (US); Robert Marshall Stowell, Wilsonville, OR (US); Edmund Minshall, Sherwood, OR (US); Timothy Cleary, Portland, OR (US)

(73) Assignee: Novellus Systems, Inc., San Jose, CA (US)

( * ) Notice: Subject to any disclaimer, the term of this patent is extended or adjusted under 35 U.S.C. 154(b) by 0 days.

(21) Appl. No.: 10/884,371

(22) Filed: Jul. 2, 2004

(65) Prior Publication Data

US 2006/0003671 A1 Jan. 5, 2006

(51) Int. Cl.
*B24B 5/00* (2006.01)

(52) U.S. Cl. ..... 451/8; 451/41; 451/285

(58) Field of Classification Search ..... 451/5, 451/285, 287, 288, 289, 41, 8, 10, 11
See application file for complete search history.

(56) References Cited

U.S. PATENT DOCUMENTS

| | | | | |
|---|---|---|---|---|
| 6,213,853 | B1 * | 4/2001 | Gonzalez-Martin et al. | 451/287 |
| 6,478,665 | B2 * | 11/2002 | Lofaro | 451/288 |
| 6,488,565 | B1 * | 12/2002 | White et al. | 451/5 |
| 6,558,238 | B1 * | 5/2003 | Crevasse et al. | 451/287 |
| 2002/0177386 | A1 * | 11/2002 | Smith | 451/5 |
| 2003/0209320 | A1 * | 11/2003 | Sommer | 156/345.12 |
| 2005/0227595 | A1 * | 10/2005 | Marquardt et al. | 451/285 |
| 2005/0230354 | A1 * | 10/2005 | Hardikar | 216/88 |

* cited by examiner

*Primary Examiner*—Jacob K. Ackun, Jr.
(74) *Attorney, Agent, or Firm*—Ingrassia Fisher & Lorenz, P.C.

(57) ABSTRACT

Methods and apparatus are provided for the chemical mechanical planarization (CMP) of a surface of a work piece. In accordance with one embodiment of the invention the apparatus comprises a plurality of CMP systems, a plurality of load cups for loading unprocessed work pieces into and unloading processed work pieces from the plurality of CMP systems, a plurality of cleaning stations for cleaning processed work pieces unloaded from the CMP systems, and a single robot configured to transfer unprocessed work pieces to the plurality of load cups and to transfer processed work pieces from the load cups to the plurality of cleaning stations.

11 Claims, 13 Drawing Sheets

130

CMP APPARATUS AND METHOD

CROSS-REFERENCE TO RELATED APPLICATION

This application claims the benefit of prior, copending U.S. patent application Ser. No. 10/884,371, filed Jul. 2, 2004.

TECHNICAL FIELD

The present invention generally relates to apparatus and method for the chemical mechanical planarization of a surface of a work piece, and more particularly relates to CMP apparatus and method that are space and time efficient.

BACKGROUND

The manufacture of many types of work pieces requires the substantial planarization or polishing of at least one surface of the work piece. Examples of such work pieces that require a planar surface include semiconductor wafers, optical blanks, memory disks, and the like. One commonly used technique for planarizing the surface of a work piece is the chemical mechanical planarization (CMP) process. The terms "planarization" and "polishing," or other forms of these words, although having different connotations, are often used interchangeably by those of skill in the art with the intended meaning conveyed by the context in which the term is used. For ease of description such common usage will be followed and the term "chemical mechanical planarization" will generally be used herein with that term and "CMP" conveying either "chemical mechanical planarization" or "chemical mechanical polishing." The terms "planarize" and "polish" will also be used interchangeably. The CMP method typically requires the work piece to be loaded into and mounted precisely on a carrier head in a manner such that the surface to be planarized is exposed. The exposed side of the work piece is then held against a polishing pad and relative motion is initiated between the work piece surface and the polishing pad in the presence of a polishing slurry. The mechanical abrasion of the surface caused by the relative motion of the work piece with respect to the polishing pad combined with the chemical interaction of the slurry with the material on the work piece surface ideally produces a planar surface. Typically the work pieces are processed in batches or lots that include a plurality of work pieces. For example, with the CMP processing of semiconductor wafers, each of the wafers in a lot must be sequentially loaded from a wafer cache onto the carrier head for planarization. Following the planarization, each wafer is unloaded from the carrier head and again placed in a wafer cache, or is transferred to another carrier head for further processing, or is transferred to a subsequent processing apparatus such as a cleaning station.

The CMP processing of work pieces can be a slow process, especially because the work pieces must be processed individually rather than in batches. To provide for a high throughput for a manufacturing process that includes a CMP step, a number of CMP systems must therefore be provided to process a number of work pieces in parallel. Present CMP systems, although functional and capable of producing the desired end result of planar work piece surfaces, have been large, inefficient users of manufacturing area floor space. It is impractical to increase manufacturing capacity by arbitrarily adding additional CMP systems because manufacturing area floor space is expensive and adds to the overall cost of manufacture of the work piece.

Accordingly, it is desirable to provide a chemical mechanical planarization (CMP) apparatus that overcomes the shortcomings of prior art CMP apparatus and allows efficient use of manufacturing area floor space and yet is efficient to maintain and operate. In addition, it is desirable to provide an efficient method for polishing the surfaces of a plurality of work pieces. Furthermore, other desirable features and characteristics of the present invention will become apparent from the subsequent detailed description and the appended claims, taken in conjunction with the accompanying drawings and the foregoing technical field and background.

BRIEF DESCRIPTION OF THE DRAWINGS

The present invention will hereinafter be described in conjunction with the following drawing figures which illustrate various embodiments of the invention and wherein like numerals denote like elements

DETAILED DESCRIPTION OF EXEMPLARY EMBODIMENTS

The following detailed description is merely exemplary in nature and is not intended to limit the invention or the application and uses of the invention. Furthermore, there is no intention to be bound by any expressed or implied theory presented in the preceding technical field, background, or the following detailed description. Without loss of generality, but for ease of description and understanding, the following description of the invention will focus on applications to only one specific type of work piece, namely a semiconductor wafer. The invention, however, is not to be interpreted as being applicable only to semiconductor wafers. Those of skill in the art instead will recognize that the invention can be applied to any generally disk shaped work piece.

Figure 1:
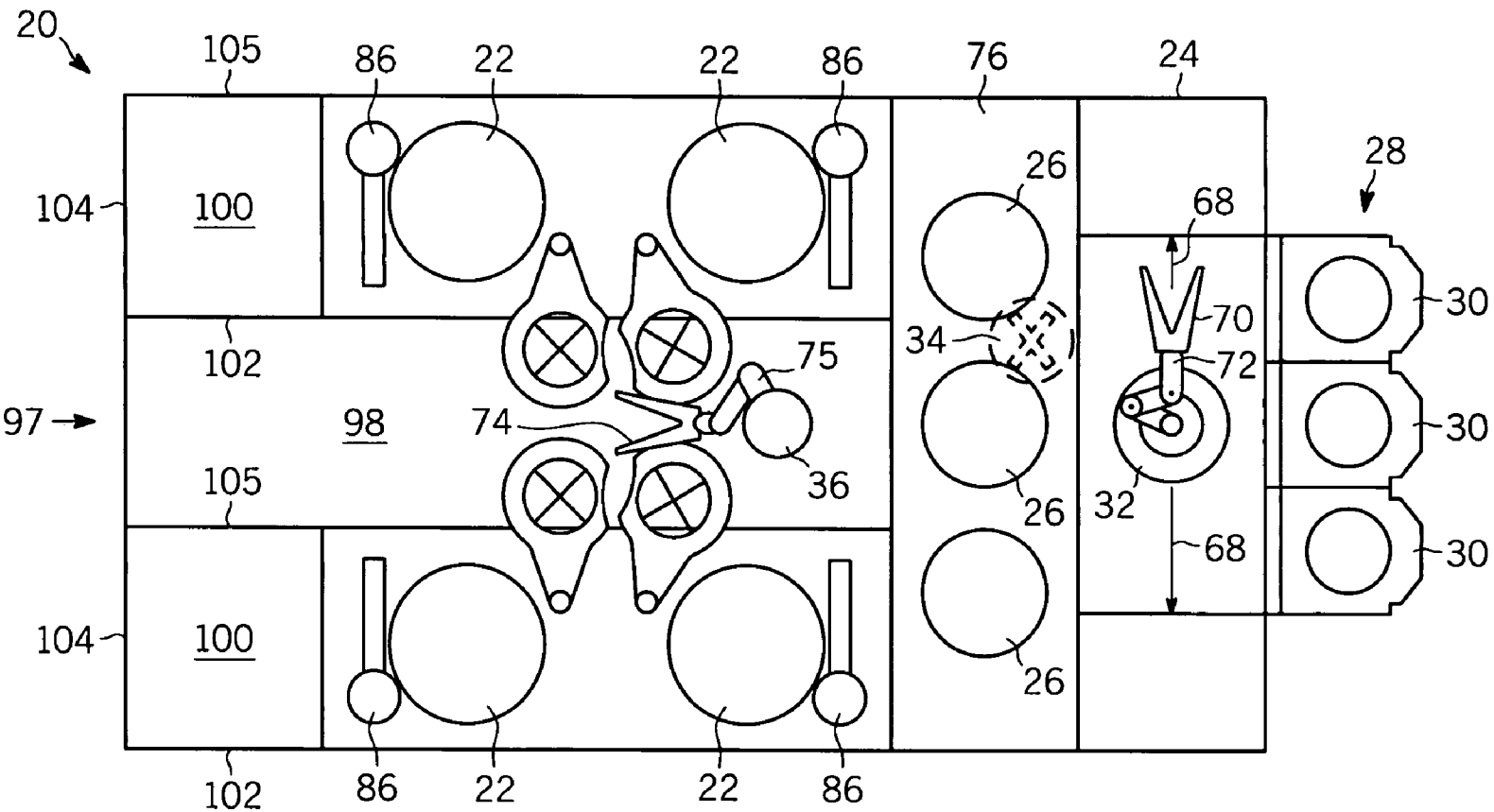
FIG. 1 illustrates, in top plan view, a CMP apparatus in accordance with one embodiment of the invention.

In accordance with one embodiment of the invention, as illustrated in FIG. 1, a CMP apparatus 20 is provided that combines a plurality of CMP systems 22 in a work efficient and space efficient manner. Preferably the CMP systems are arrayed in two spaced apart rows, spaced apart by a service access corridor 98. In accordance with a further embodiment of the invention, CMP apparatus 20 includes a front end module 24 that includes a cleaning module 76 having a plurality of cleaning stations 26 arrayed along a line at the end of and substantially perpendicular to the rows of CMP systems. In such a CMP apparatus a plurality of semiconductor wafers can be polished in parallel in the CMP systems and then can be cleaned in parallel in the cleaning stations. Although four CMP systems and three cleaning stations are illustrated, CMP apparatus 20 can include a greater or lesser number of either.

The front end module is further configured to include a wafer cache station 28 that can accommodate a plurality of individual wafer caches 30. In a preferred embodiment a front end robot 32 is located in the front end module and is employed to transfer a selected wafer from a selected wafer cache 30 to a wafer hand off station 34. A transfer robot 36, positioned between the two rows of CMP systems, retrieves the selected wafer from the hand off station and transfers it to a selected one of the plurality of CMP systems 22. The selected wafer is polished at the selected CMP system. Upon completion of the polishing operation the wafer is transferred by transfer robot 36 from the selected CMP system to another of the CMP systems for further processing or is transferred to a selected one of the plurality of cleaning stations 26 for cleaning. When the cleaning operation is completed, front end robot 32 transfers the now planarized and cleaned wafer to one of the individual wafer caches. Thus front end robot 32 services the wafer cache station and each of the plurality of cleaning stations and transfers wafers to the wafer hand off station. Transfer robot 36 services each of the CMP systems, retrieves unprocessed wafers from the hand off station, and transfers processed wafers to the plurality of cleaning stations. As used herein, the terms "unprocessed wafer" or "unprocessed work piece" shall refer to a wafer or work piece prior to a CMP operation, and the terms "processed wafer" or "processed work piece" shall refer to a wafer or work piece after a CMP operation.

Figure 2:
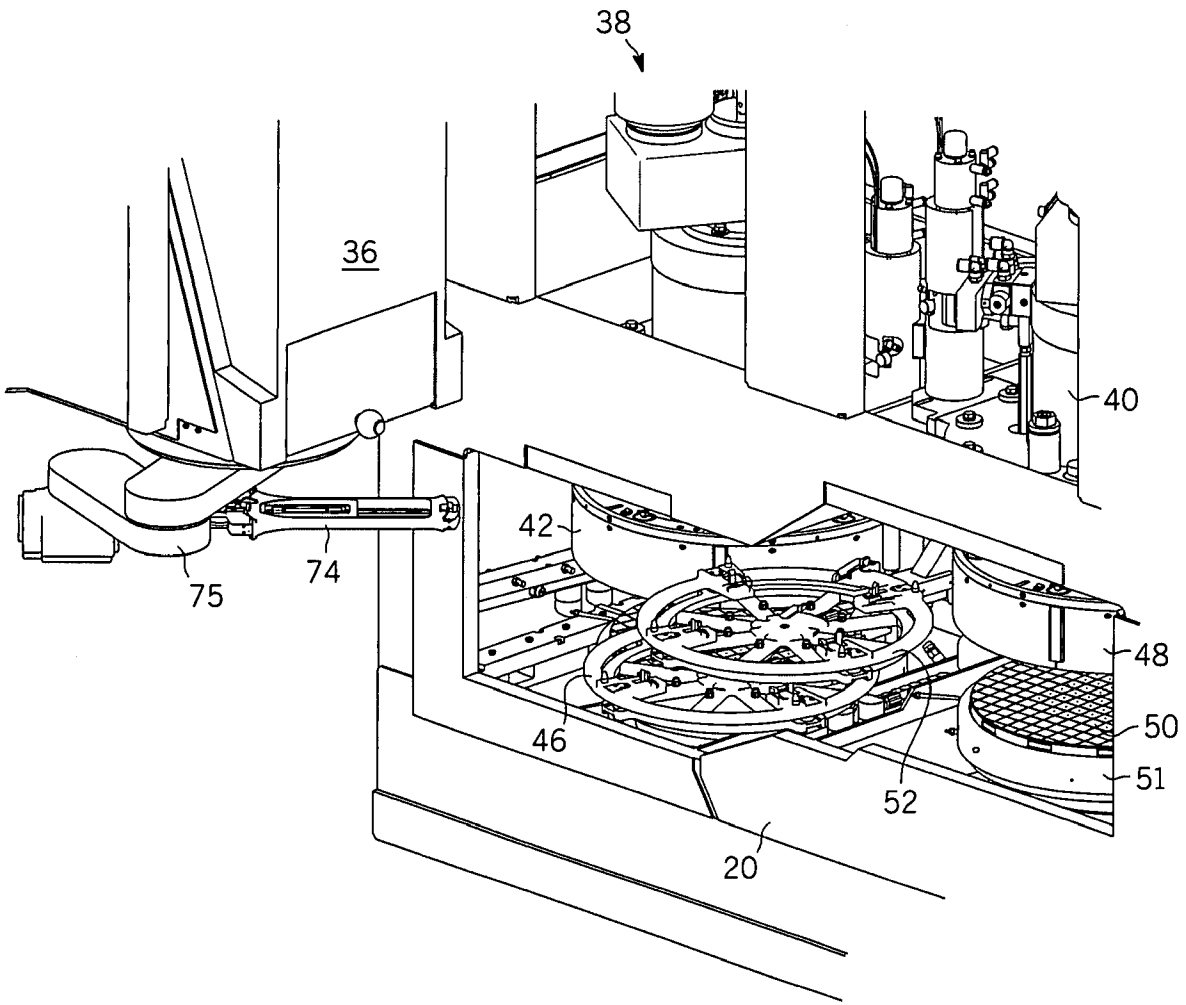
FIG. 2 illustrates, in perspective view, two CMP systems.

FIG. 2 illustrates, in perspective view, a portion of two of the CMP systems 22 in greater detail. CMP systems 38 and 40 are positioned adjacent each other along one side of CMP apparatus 20. The two CMP systems are identical except as explained below. CMP system 38 includes a wafer carrier head 42 and a polish pad on a polish platen (polish pad and polish platen not visible in this view). In a preferred embodiment, CMP system 38 also has associated with it a load cup 46 that is configured to load unprocessed wafers into wafer carrier head 42 and to unload processed wafers from the carrier head. In a similar manner, CMP system 40 includes a wafer carrier head 48, a polish pad 50 on a polish platen 51, and has associated with it a load cup 52. The wafer carrier head, the polish pad and platen, and the basic CMP operation are all well known in the art and will not be described in detail. A preferred load cup and its operation are described and illustrated in copending application Ser. No. 10/821,758 filed Apr. 9, 2004 which is incorporated herein by reference in its entirety.

Briefly, a load cup such as load cup 46 is configured to pivot about an axis from an off-load position (as illustrated) to a load position underneath and aligned with wafer carrier head 42. When in the off-load position the load cup can receive an unprocessed wafer from transfer robot 36. The load cup then pivots about its axis to the load position. Once positioned and aligned beneath wafer carrier head 42, the load cup is raised to contact the wafer carrier head and to transfer the wafer to the wafer carrier head. The load cup then lowers to a plane out of contact with the wafer carrier head and pivots back to the off load position. Once the load cup has returned to the off-load position, wafer carrier head 42 is lowered to place the surface of the wafer that is to be planarized in contact with the polish pad mounted on the polish platen. A polish slurry is supplied to the surface of the polish pad and relative motion is initiated between the wafer carrier head, and hence the wafer, and the polish pad. Preferably the slurry is delivered through the pad (delivery holes not illustrated) to the surface of the polish pad. In accordance with one embodiment of the invention the polish pad and associated polish platen move in orbital motion with respect to the carrier head and wafer. By moving the polish pad in relatively small diameter orbits, the size of the inventive CMP apparatus can be reduced relative to the size of a CMP apparatus that utilizes a large polish pad in rotary motion. The surface of the wafer is polished by the combined mechanical abrasive action caused by the relative motion between the wafer surface and the polish pad in the presence of an abrasive in the slurry and by the chemical reaction of the slurry with the constituents on the wafer surface. The CMP operation on this CMP system may terminate when the planarization process is completed or when the process has reached a predetermined intermediate point. In accordance with some CMP process flows, the planarization may be completed on another of the plurality of CMP systems. Following the termination of the CMP operation on CMP system 38, wafer carrier head 42 and the now processed wafer are raised to a position out of contact with the polish pad. Load cup 46 again pivots about its axis to the load position and the processed wafer is transferred from the wafer carrier head to the load cup. In accordance with one embodiment of the invention, the planarized surface of the processed wafer is sprayed with a fluid from nozzles on the load cup once the wafer is transferred to the load cup. The fluid, which may include a surfactant, aids in maintaining the surface of the processed wafer in a hydrophilic state. Load cup 46 then pivots about its axis to the off-load position where transfer robot 36 removes the processed wafer from the load cup. In accordance with a further embodiment of the invention (not illustrated) fluid nozzles may also be attached, for example, to the framework of the CMP apparatus, and these fluid nozzles may be used to spray a fluid onto the back or unprocessed side of the wafers as they are removed from the CMP system. Spraying the back of the wafers aids in removing residue from the wafers. Robot 36 transfers the processed wafer to either another CMP system to continue the CMP processing or to the cleaning module for cleaning.

Referring again to FIG. 2, in accordance with an embodiment of the invention, load cup 46 and load cup 52, both illustrated in their respective off-load positions, are positioned on separate horizontal planes with a vertical separation between the horizontal planes. Positioning the two load cups on different horizontal planes allows one of the load cups, load cup 52 in the illustrated embodiment, to at least partially overlie the other load cup when both are in the off-load position. Allowing one of the load cups to overlie the other load cup allows the two CMP systems to be located closer together than would otherwise be possible, and this, in turn, allows the total CMP apparatus to have a smaller footprint and to take up less valuable manufacturing area floor space.

In accordance with a further embodiment of the invention, as also illustrated in FIG. 2, the polish pad and associated polish platen of CMP system 38 and polish pad 50 and its associated platen 51 of CMP system 40 are positioned on separate horizontal planes with a vertical separation between the horizontal planes. Positioning the two polish pads on different horizontal planes, the polish pad of CMP system 38 on a lower horizontal plane than polish pad 50 in the illustrated embodiment, positions the plane of the polish pad of CMP system 38 at the same vertical offset spacing relative to the off-load plane of load cup 46 as the plane of polish pad 50 is to the off-load plane of load cup 52. Although the same vertical offset spacing between the planes of the load cup and its associated polish pad is not required for each CMP system, it allows the same type of vertical motion mechanism to be used for each of the load cups. This helps to reduce both initial cost of the equipment as well as the cost of maintenance.

Figure 3:
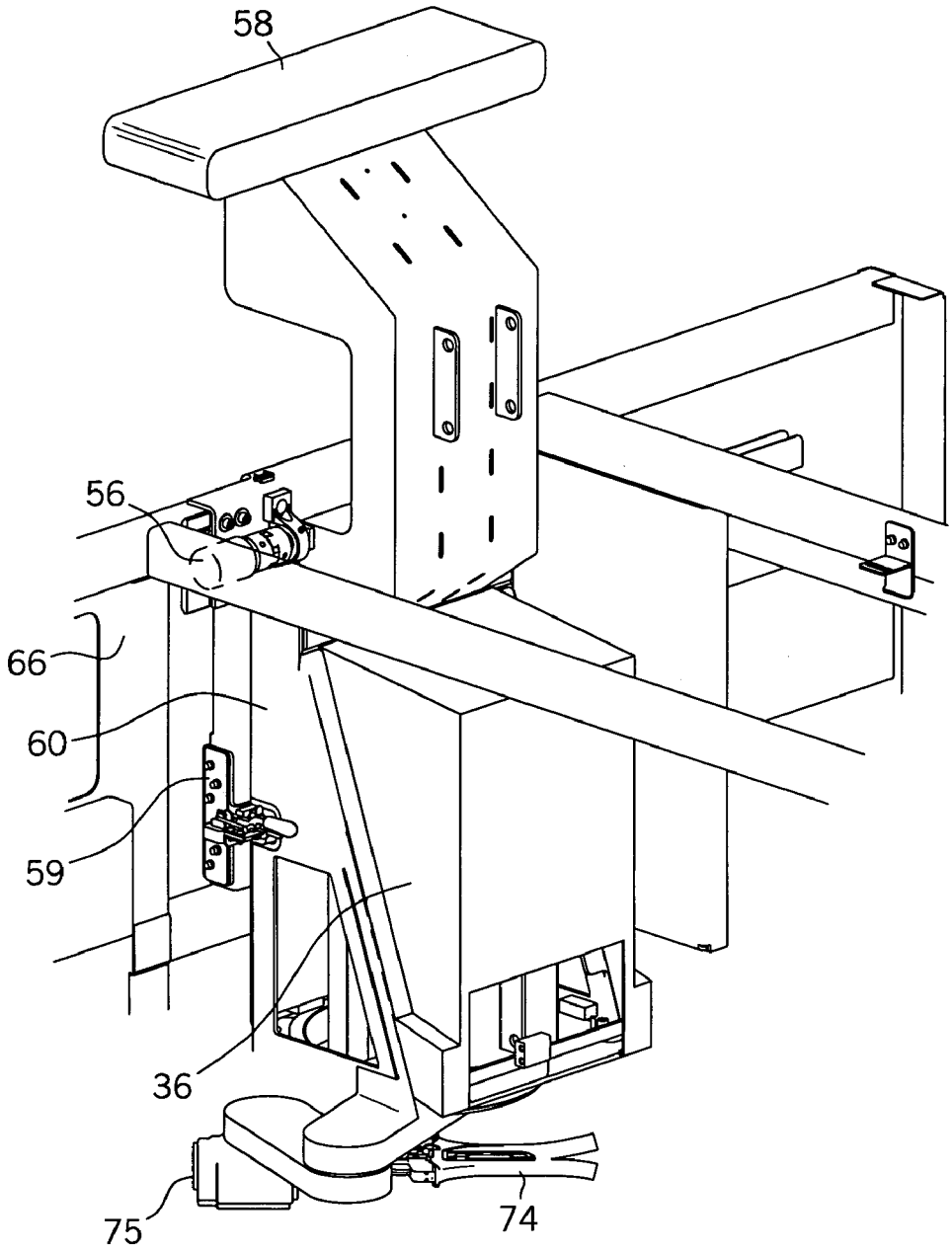
FIG. 3 schematically illustrates, in perspective view, a transfer robot in accordance with a further embodiment of the invention.
Figure 4:
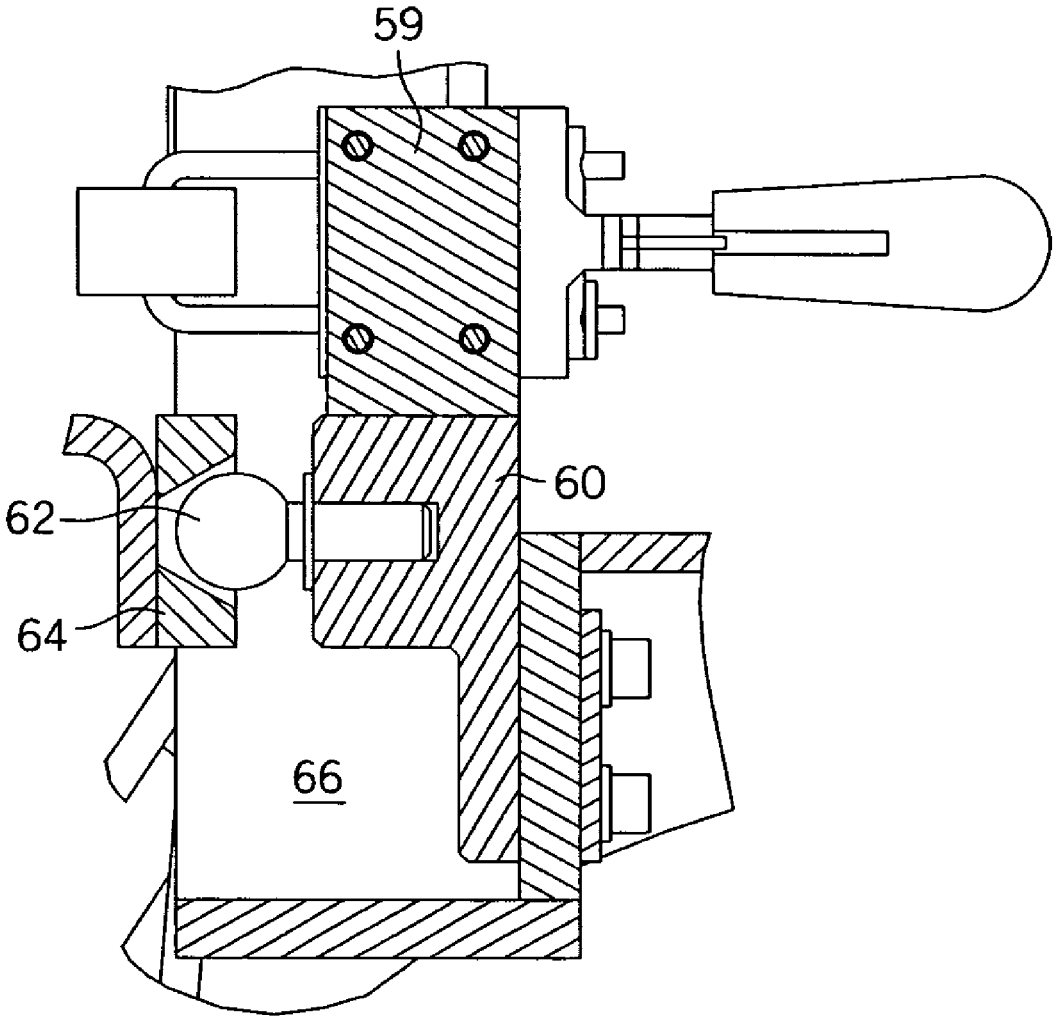
FIG. 4 illustrates, in side view, an alignment mechanism for a transfer robot.

As explained above, a single transfer robot 36, positioned between the spaced apart rows of CMP systems within service access corridor 98, is able to transfer unprocessed wafers to the load cups of the plurality of CMP systems and to transfer processed wafers from those load cups. To make the CMP apparatus as compact as possible and to minimize the footprint of the apparatus, the two rows of CMP systems are preferably spaced as close together as possible, leaving only enough space for the operation of transfer robot 36 and for service access to the CMP systems. The close spacing of the two rows of CMP systems and the positioning of the transfer robot between the two rows, however, makes it difficult for maintenance or other personnel to access the CMP systems, for example as needed for maintenance or the like. A further embodiment of the invention that addresses this problem is illustrated in FIG. 3. Transfer robot 36 is configured to pivot upwardly about a horizontal axis 56 from a working position to a raised position in which the robot is substantially horizontal in a plane near the top of or above the height of the CMP systems. A counter weight 58 is attached to the framework 60 supporting the robot, with the counter weight on the opposite side of axis 56 from the transfer robot itself. Coupling the counter weight to the robot makes it easier to pivot the robot. The transfer robot can be locked in either the working position or the raised position by any conventional clamping mechanism. A clamping mechanism for locking the transfer robot in the working position is illustrated at 59. Robotic transferring of wafers to and from the load cups and a to selected one of the plurality of cleaning stations by the transfer robot requires the robot, in the down or operative working position, to be precisely located relative to the positions of the load cups of the CMP systems and to the positions of the cleaning stations. Precise positioning of the transfer robot in the working position is accomplished, in accordance with one embodiment of the invention, by alignment aids 62, 64 on robot framework 60 and on CMP apparatus framework 66, respectively, as illustrated in cross section in FIG. 4. Alignment aid 62 can be, for example, a tapered pin or a ball extending outwardly from framework 60 and configured to mate with a tapered concave alignment aid 64 affixed to framework 66. During an initial transfer robot alignment, alignment aid 64 can be positioned in the appropriate location to insure alignment accuracy when the two alignment aids are properly mated. Once the appropriate location of alignment aid 64 is determined, the alignment aid can be permanently clamped in place by any conventional clamping mechanism (not illustrated). Transfer robot 36 can thus be pivoted between a correctly aligned working position and an elevated position that allows access to the CMP systems for maintenance or the like. Alignment aids 62 and 64 insure that the transfer robot is always returned to the correct working position. Once the transfer robot is returned to the properly aligned working position, the transfer robot can be securely clamped in that position (such as by clamping mechanism 59) until the next time it must be pivoted to the raised position to provide access to the CMP systems.

Referring again to FIG. 1, in the illustrated embodiment there are three individual wafer caches 30, although there could be more or less. In a preferred embodiment the individual wafer caches are of the type commonly used in the semiconductor industry in which the wafers are held horizontally, in a face up orientation, in slots of a carrier. By "face up orientation" is meant that the surface of the wafer that is to be planarized in the CMP apparatus is facing upwardly. The carriers can be of the type in which wafers are sealed to prevent contamination as the wafers are moved between operations. When the wafers are to be processed in the CMP apparatus, the carrier is attached to the wall of the apparatus, the sealing door of the carrier is opened into the front end module, and the wafers are exposed to the atmosphere within the front end module of the CMP apparatus. When the CMP operation and wafer cleaning are completed and the wafers are returned to a carrier, the door is again sealed before the carrier is removed from the CMP apparatus.

Front end robot 32 has an end effector 70 attached to the end of an extensible arm 72. The robot removes a wafer from the carrier by inserting the end effector into the carrier and lifting the wafer from the carrier. The end effector preferably touches only the extreme outer portion of the back side of the wafer or the edge of the wafer and avoids all contact with the front surface of the wafer because any additional contact with the wafer may cause defects that could lower the yield of the wafer. Front end robot 32 is preferably able to slide horizontally in the direction indicated by double headed arrow 68 along a track (not illustrated). The front end robot and the extensible arm of the front end robot are also able to move vertically at any location along the track to access wafers that are at different heights. Moving along the track, front end robot 32 is able to remove unprocessed wafers from or place cleaned wafers into selected locations in selected ones of individual wafer caches 30. When the front end robot removes a selected unprocessed wafer from one of the wafer caches, the robot transfers the wafer, still face side up, to a wafer hand off station 34 preferably located underneath the plurality of cleaning stations 26. The wafer hand off station beneath the cleaning station is in a location accessible to both front end robot 32 and transfer robot 36 and is in a location not needed for any other purpose. Accordingly, the wafer hand off station does not require additional space that would require enlarging the footprint of the CMP apparatus. The wafer hand off station can be, for example, a stand upon which the wafer can be placed temporarily. The stand can be configured, for example as a plurality of tapered circular posts arranged about a circle having a diameter only slightly larger than the diameter of the wafer. The wafer can sit on the tapered posts and be supported, as with end effector 70, only at the outer extremity of the back surface or the edge of the wafer.

Referring again to FIGS. 1 and 2, as illustrated, transfer robot 36 also has an end effector 74 on the end of an extensible arm 75. End effector 74 should be configured to grasp the wafer by the edges or to otherwise grasp the wafer in a manner that allows the transfer robot to invert or turn the wafer over. End effector 74 is preferably of the type disclosed and illustrated in application Ser. No. 10/040,996 filed Nov. 9, 2001, which is incorporated herein by reference in its entirety. Transfer robot 36 and end effector 74 grasp the wafer that has been placed on wafer hand off station 34, invert the wafer so that the front side, the side that is to be polished, is facing down. The wafer is then transferred, in this face down orientation, to a load cup such as load cup 46. Then, as described above, the wafer is transferred to wafer carrier head 42, a CMP operation is carried out, and the wafer is again transferred to the load cup. In accordance with one embodiment of the invention, transfer robot 36 and end effector 74 remove the processed wafer from the load cup, invert the wafer so that the polished side is up, and transfer the wafer to a selected one of the plurality of cleaning stations 26. In this manner the single transfer robot is capable of transferring an unprocessed wafer to any one of the plurality of CMP systems 22 and then transferring a processed wafer from any one of the plurality of CMP systems to another of the plurality of CMP systems or to any one of the plurality of cleaning stations 26.

Figure 5:
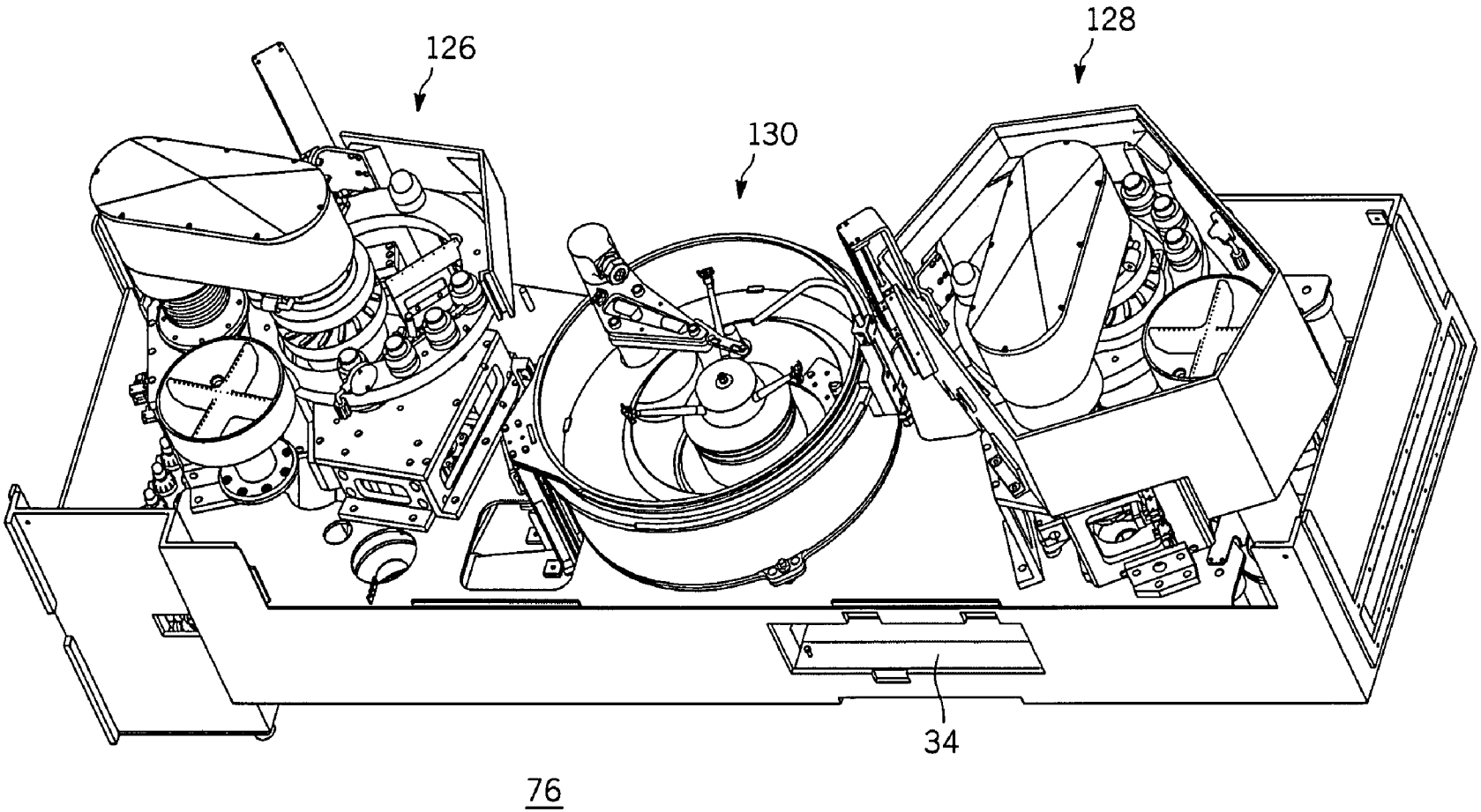
FIG. 5 illustrates, in perspective view, a cleaning module in accordance with an embodiment of the invention.
Figure 6:
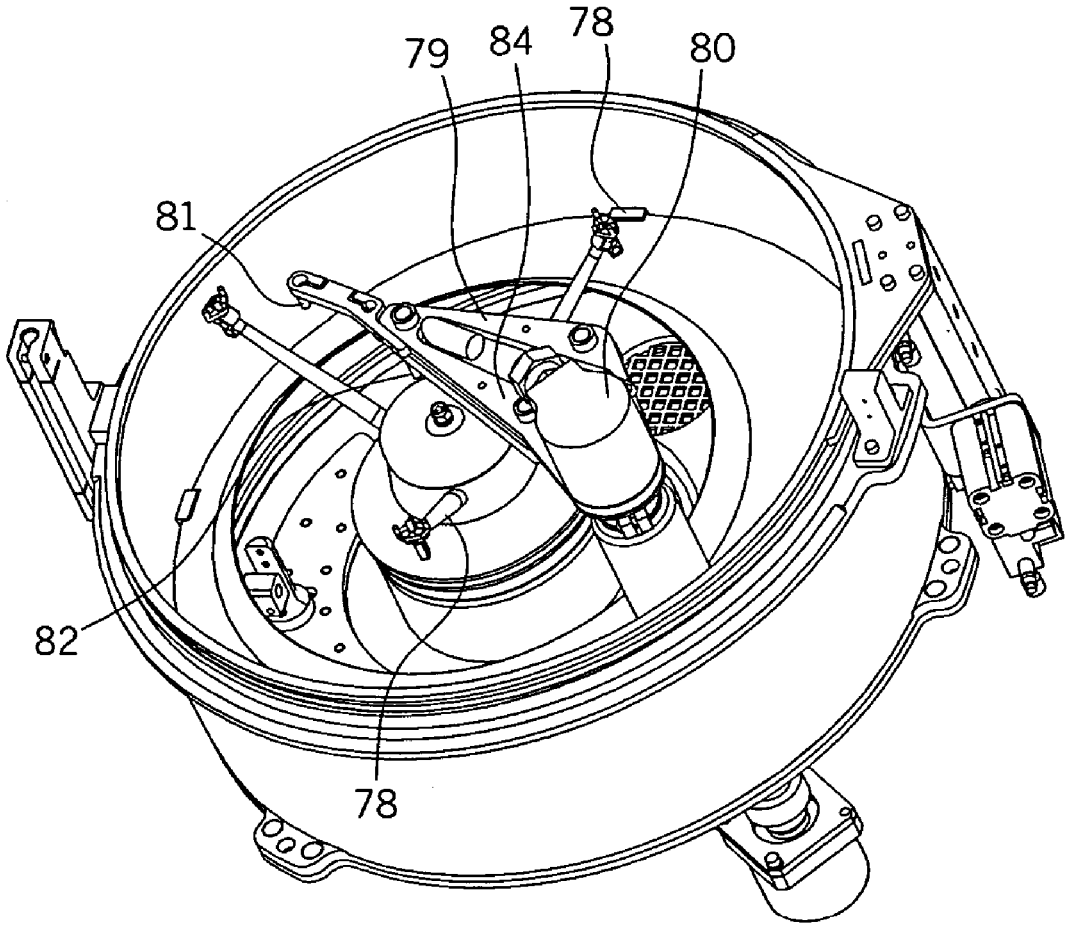
FIG. 6 illustrates, in perspective view, a vapor phase cleaner/drier.

FIG. 5 illustrates a cleaning module 76 including a plurality of cleaning stations 26, in accordance with one embodiment of the invention. Also illustrated in FIG. 5 is the location of wafer hand off station 34. In accordance with this embodiment of the invention cleaning stations 26 included in cleaning module 76 include a combination of contact and non-contact cleaners. For example, as illustrated, cleaning module 76 can include two contact cleaners such as two brush type cleaners 126 and 128 and a non-contact cleaner such as a vapor phase wafer cleaner/drier 130. In accordance with alternate embodiments of the invention, cleaning module 76 can also include, for example, other types of contact or non-contact cleaners such as one or more conventional spin-rinse-driers instead of the vapor phase wafer cleaner/drier and or one or both of the brush type cleaners. Brush type cleaners and spin-rinse driers are well known and need not be described herein. Vapor phase wafer cleaner/drier 130, illustrated in more detail in FIG. 6, includes a plurality of supports 78 upon which a processed wafer can be placed by transfer robot 36 (not illustrated in FIG. 6). Supports 78 are configured to support the wafer at the extreme outer periphery of the wafer. A moveable arm 79 is configured to pivot about an axis 80 from a position outside the periphery of the wafer to a position over and spaced slightly above the processed wafer after the wafer is placed on the supports. In accordance with one embodiment of the invention, the moveable arm includes a liquid dispensing nozzle 81 that can dispense a cleaning liquid onto the surface of the wafer. The moveable arm further includes a vapor dispensing nozzle 82. The vapor dispensing nozzle dispenses a drying vapor onto the surface of the wafer to aid in drying the wafer surface after the cleaning liquid has been applied. In a preferred embodiment of the invention moveable arm 79 also includes a megasonic transducer 84. The megasonic transducer includes a flat, active lower surface that can be positioned over and closely spaced above the surface of the wafer. When a processed wafer is placed on supports 78, for example after the wafer has been cleaned at one of the brush cleaners, the moveable arm is positioned near the center of the wafer and a cleaning liquid is dispensed from liquid dispensing nozzle 81 onto the wafer surface. The megasonic transducer, positioned over the wafer surface, is energized so that megasonic emanations from the transducer can be utilized to help in dislodging contaminant particles from the surface. Following cleaning by the cleaning liquid and the megasonic transducer, the wafer surface is dried by dispensing a drying vapor from vapor dispensing nozzle 82. The drying vapor can be, for example, isopropyl alcohol vapor. As an alternative to vapor drying, the wafer can also be dried by spin drying. During the cleaning and drying operation the moveable arm is configured to sweep from the center of the wafer to a position near the periphery of the wafer. Supports 78 are coupled to a motor (not illustrated) that is configured to rotate the wafer during the cleaning and drying operation so that the entire surface of the wafer is cleaned and then dried. After the wafer is cleaned and dried, front end robot 32 removes the wafer from supports 78 and transfer the wafer to one of the wafer caches.

Figure 7:
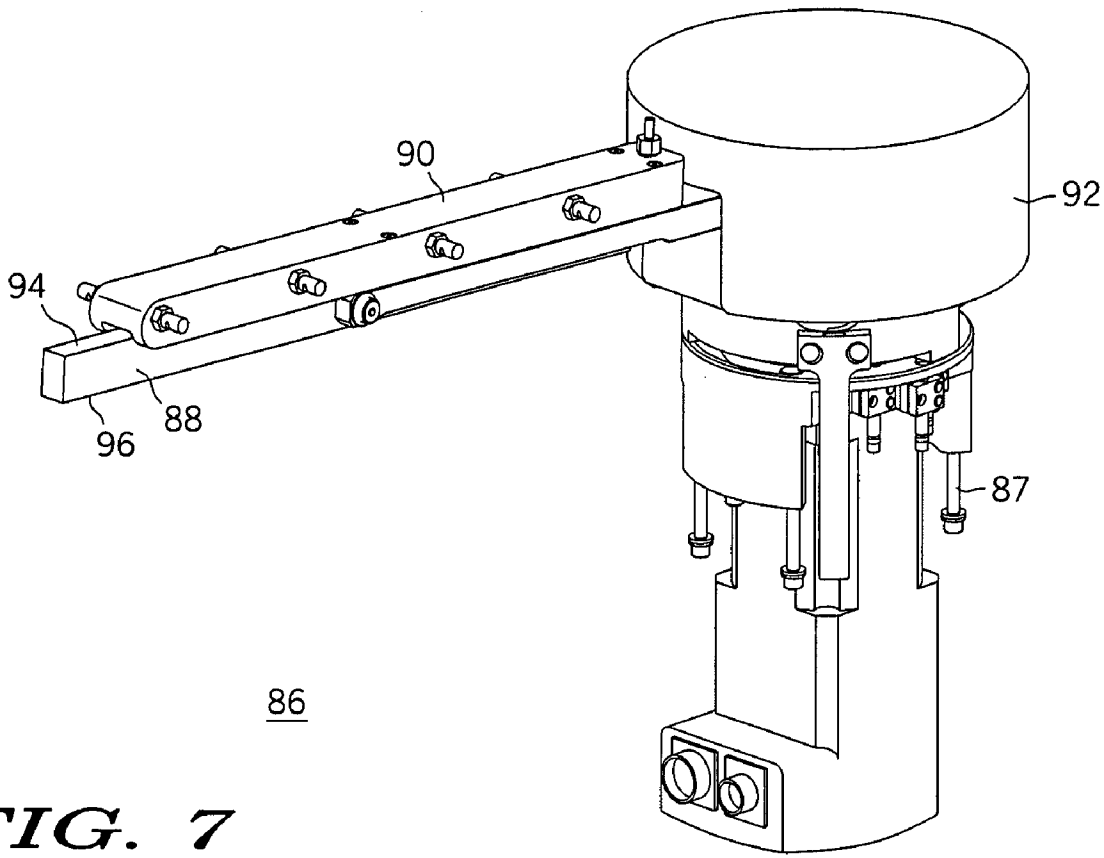
FIG. 7 illustrates, in perspective view, a pad conditioner in accordance with a further embodiment of the invention.

A further embodiment of the invention is illustrated in FIG. 7 and with reference again to FIG. 1. In accordance with this embodiment of the invention, each of the plurality of CMP systems 22 further includes a pad conditioner 86. The pad conditioner is utilized to condition the surface of the polish pad of the associated CMP system. Each pad conditioner is mounted to the table adjacent its associated CMP system. The pad conditioner can be mounted to the table with bolts 87, or the like. A portion of the pad conditioner may extend below the surface of the table. As illustrated in FIG. 7, the pad conditioner includes an abrasive element 88 attached to an arm 90; The arm 90 is configured to pivot from an off-pad location, as illustrated in FIG. 1, to a position wherein the abrasive element sweeps across and conditions the polish pad. During the conditioning the pad is set in oscillatory motion so that the pad surface is conditioned evenly. A mechanism 92 coupled to the arm includes a servo motor (not illustrated) that controls the sweeping motion of arm 90. Mechanism 92 further includes apparatus such as a balanced double sided pneumatic cylinder (also not illustrated) that controls the downward pressure of abrasive element 88 against the polish pad. In accordance with a preferred embodiment of the invention, the abrasive element is double sided, with each side 94, 96 having a slightly convex curved abrasive surface. The convex curved surface is achieved by radiusing the corners of the abrasive element. The abrasive element is removeably attached to arm 90 so that the two sides can be used alternately, with either side 94 or side 96 being capable of being used to condition the polish pad.

Figure 8:
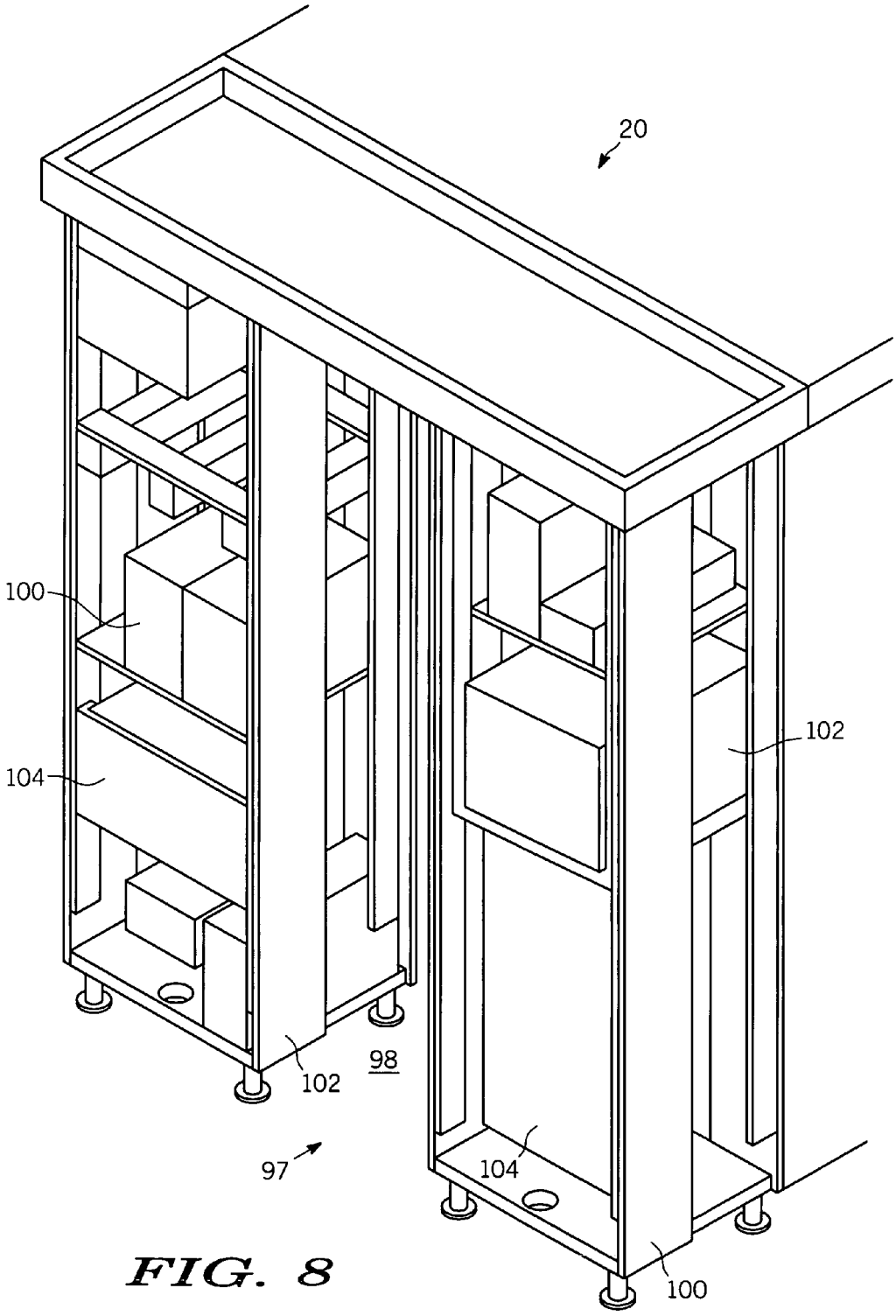
FIG. 8 illustrates, in perspective view, electrical cabinets for use in the CMP apparatus of FIG. 1.

A further embodiment of the invention is illustrated in FIG. 8 and with reference again to FIG. 1. As illustrated in FIG. 1, CMP apparatus 20 is configured with an open end 97 through which access can be made to transfer robot 36 and to service access corridor 98 between the two rows of CMP systems. Electrical cabinets 100 are located on either side of open end 97. The electrical cabinets contain the majority of the electrical boards, controllers, and the like necessary to control and run the CMP apparatus. In accordance with a preferred embodiment of the invention, the contents of each of the electrical cabinets are accessible from three sides 102, 104 (and a third side 105 not visible in this perspective illustration). Doors, which are not shown in FIG. 8, can be opened on each of the three sides. In this manner, and in accordance with this embodiment of the invention, all of the electrical components are easily accessible without withdrawing boards or other components to access components positioned in the back of the cabinets. Further, because boards and other components can be easily accessed, no cables need to flex or move to allow access, and this increases reliability.

Figure 9:
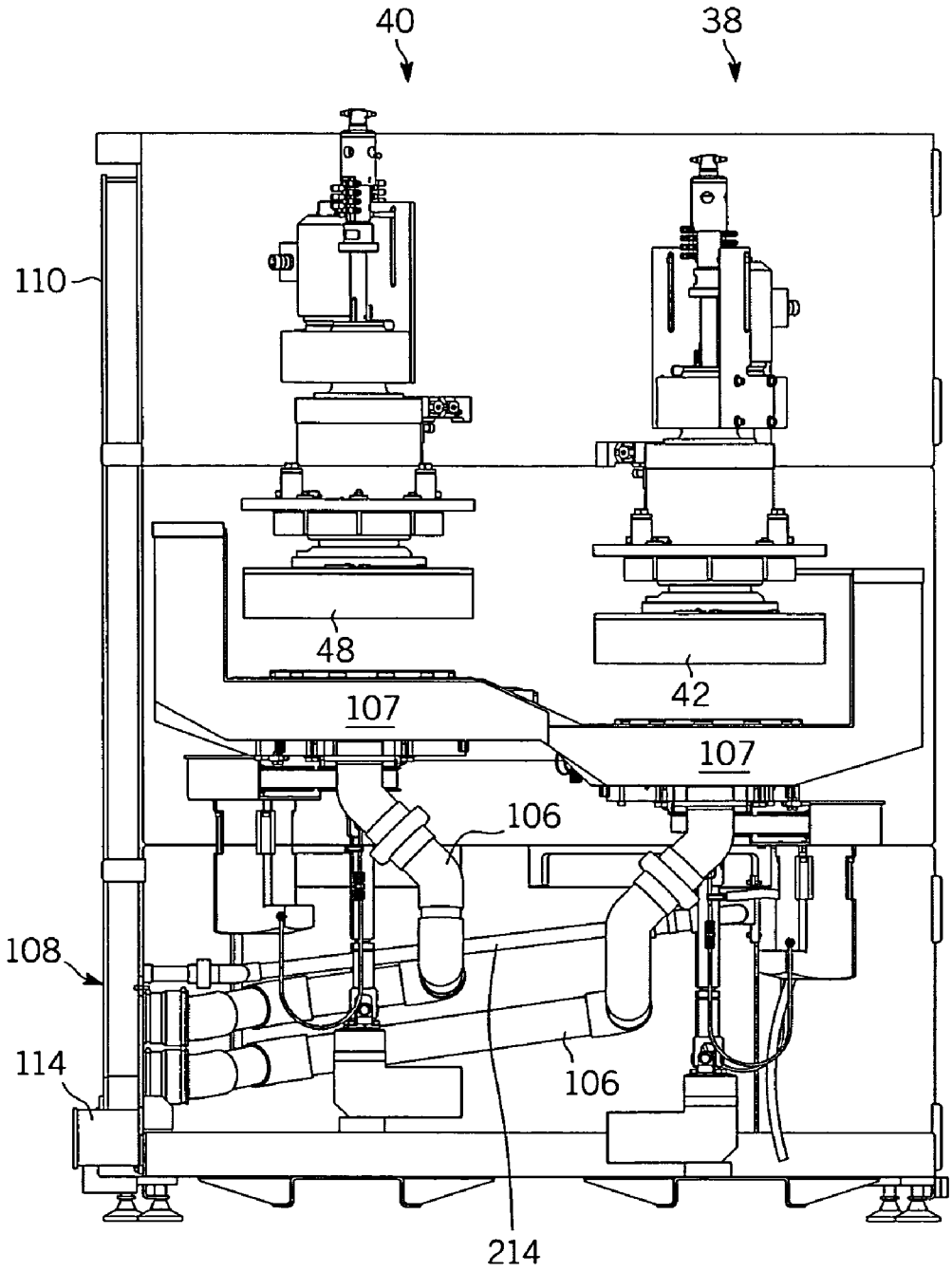
FIGS. 9 and 10 illustrate, in side and perspective views, respectively, an effluent separation system in accordance with another embodiment of the invention.
Figure 10:
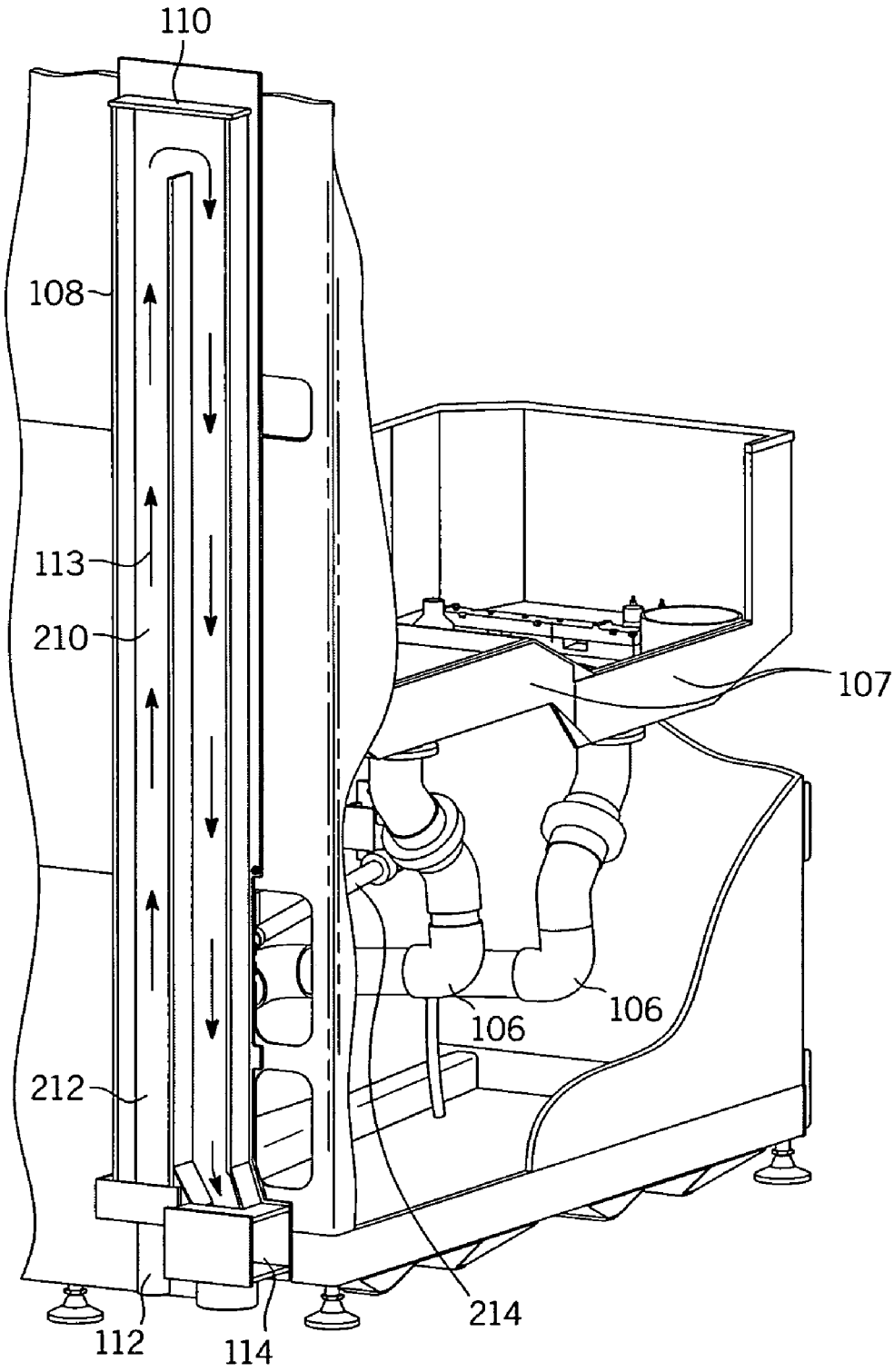

A still further embodiment of the invention is illustrated in FIGS. 9 and 10. FIG. 9 illustrates, in side view, two CMP systems 38 and 40 as viewed from outside the CMP apparatus. A side panel, normally enclosing the side of the CMP apparatus, has been removed in this illustration. FIG. 10 illustrates, in a partially cut away perspective view, an effluent separator 108 connected to the two CMP systems. During a CMP operation, slurry and possibly water and other liquids and gases are used in the polishing of a wafer. The effluent of these materials, together with the end products of the polishing, are collected in drain pans 107 and flow to chemical drains 106. The effluent, which may contain both liquids and vapors, is conveyed to effluent separator 108. Separator 108 comprises, in accordance with a preferred embodiment, a divided vertical chimney 110 with a drain 112 at the lower extremity of a first portion 210 of chimney 110 from which liquids can be extracted from the effluent and an exhaust 114 at a lower extremity of a second portion 212 of the chimney from which vapors can be extracted from the effluent. In FIG. 10 a cover, which would enclose the divided vertical chimney, has been removed to illustrate the internal structure of the separator. Effluent enters separator 108 from chemical drains 106. The liquid portion of the effluent drops out and is removed through drain 112. A vacuum pump, (not illustrated) draws the vaporous portion of the effluent up the first portion of the vertical chimney and down the second portion of the vertical chimney, as illustrated by arrows 113, to exhaust 114. Also connected to effluent separator 108 is a drain 214, the use of which will be explained below.

Figure 11:
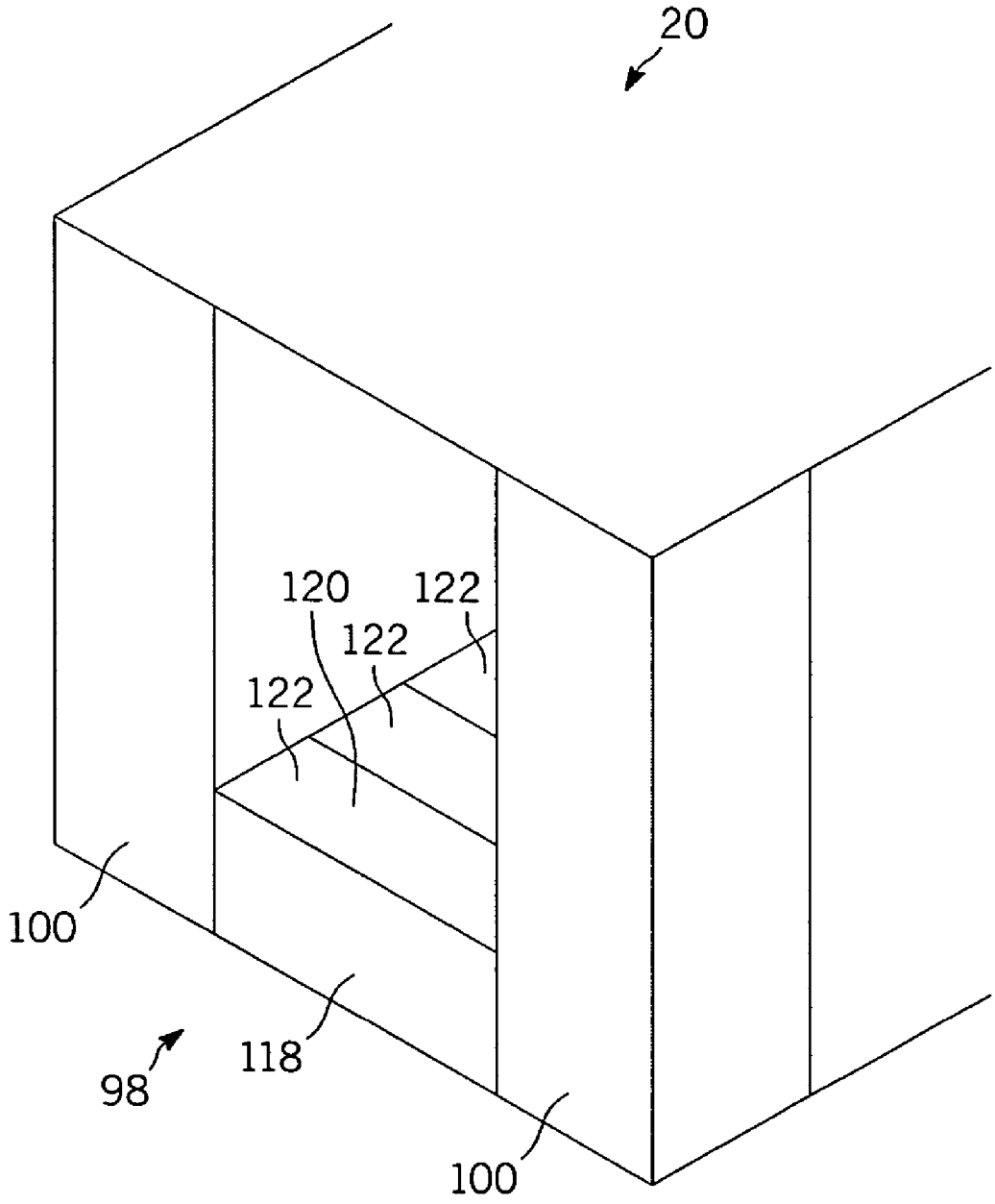
FIG. 11 illustrates a chemical distribution system module for use with the CMP apparatus of FIG. 1.

Slurry, water, cleaning chemicals, surfactants, and the like are used in the CMP and cleaning operations. In accordance with an embodiment of the invention, these materials are conveyed to the CMP systems and to the plurality of cleaning stations through a chemical distribution system module 118 that is located beneath a raised floor 120 that is positioned along service access corridor 98 between the two spaced apart rows of CMP systems as illustrated in FIG. 11. In a preferred embodiment of the invention the raised floor comprises a plurality of removable access covers 122, each one of which can be individually removed to provide access to a portion of the chemical distribution system module. In a more preferred embodiment, the access covers are optically transparent to provide visual access to the underlying chemical distribution system module. Locating the chemical distribution module beneath raised floor 120 in this manner allows all or most of the chemicals, water, vacuum, air, and the like to be supplied from a single reference area, preferably an area located near the open entrance of access corridor 98. Locating the origin of all or most of the necessary supplies at a single location makes it easier to service the CMP apparatus.

Figure 12:
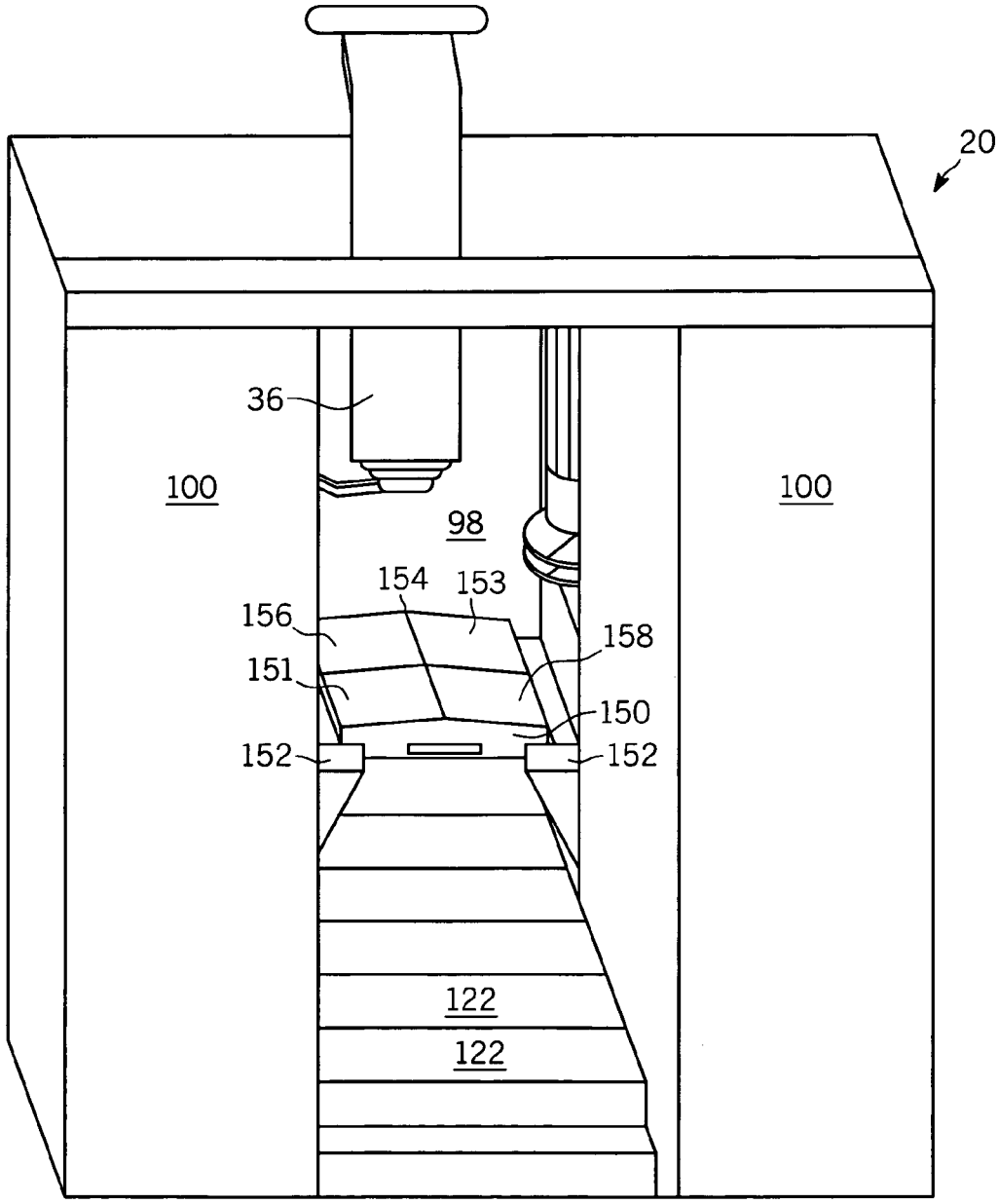
FIGS. 12 and 13 illustrate a chemical shield in accordance with a further embodiment of the invention.
Figure 13:
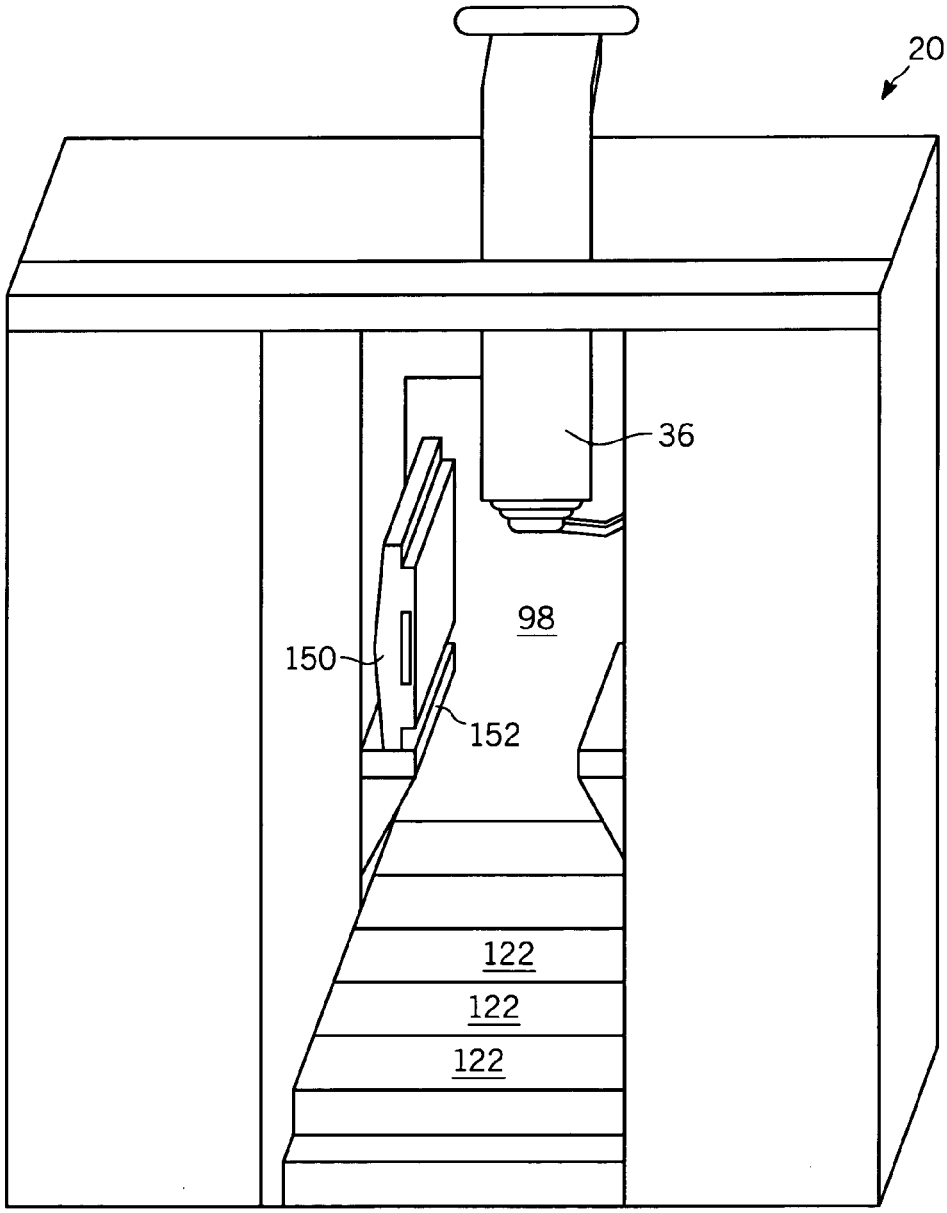

The area surrounding the CMP systems, including service access corridor 98 is a wet chemical environment in which the chemicals listed above may be found. The combination of all the possible wet chemicals in the CMP area results in an environment that makes maintenance, especially maintenance that must be accomplished quickly, difficult or even dangerous. The wet chemicals, for example, can drip onto and be present on the plurality of access covers 122. The problems attendant with the wet chemical environment are overcome, in accordance with yet another embodiment of the invention, by the use of a removable chemical shield 150 as illustrated in FIGS. 12 and 13. The figures illustrate just one exemplary embodiment of removable chemical shield 150. Those of skill in the art will recognize that many variations are possible within the scope of this embodiment. In accordance with a preferred embodiment, removable chemical shield 150 is formed in two sections 151, 153 which can be telescoped together, one section sliding under the other section. The chemical shield can be formed of a rigid, light weight plastic material, with the particular plastic chosen from those materials substantially inert to the chemicals to be encountered in this environment. For example, chemical shield 150 can be formed of polypropylene or polyvinylchloride. Chemical shield 150 hooks onto and overlaps gutters 152 attached along the walls of service access corridor 98. The gutters are positioned below the CMP systems and are connected to drain 214 (illustrated in FIGS. 9 and 10) so that any chemicals that flow into the gutters will be conveyed to drain 214 and then to effluent separator 108. Preferably chemical shield 150 is configured with a peak or high point 154 in the center and with sides 156, 158 sloping away from the peak so that any chemicals landing on the chemical shield will run downwardly to the gutters.

During normal operation of the CMP apparatus, the chemical shield is positioned as illustrated in FIG. 12, and any chemicals that drip or spray from the CMP systems or the load cups and that are not captured directly by drain pans 107, or that drip from one of the processed wafers, drip onto chemical shield 150 and are conveyed to drain 214. The chemical shield prevents these chemicals from dripping onto access covers 122. If access to the service access corridor is necessary, for example to perform maintenance on one of the CMP systems, the two portions of the chemical shield can be quickly telescoped together and, in this telescoped configuration, can be tilted to an upright position and balanced on one of the gutters as illustrated in FIG. 13. Maintenance personnel, entering the service access corridor, enter an area that is free of chemicals on the floor of the corridor. The maintenance personnel can thus quickly and safely enter the area to perform required tasks. In accordance with a further embodiment of the invention, before the two portions of the shield are telescoped and the maintenance personnel enter the access corridor, a water spray, and preferably a deionized water spray (not illustrated), located above the access corridor can be activated to rinse any of the possibly chemically contaminated portions of the CMP apparatus. Although the chemical shield, as illustrated, comprises two telescoping sections, it is not necessary that the shield be formed of two sections. By using two telescoping sections, the shield, in its tilted, upright position, is shorter and provides less impediment to accessing the CMP systems. Forming the chemical shield of three or more sections, of course, would make the tilted shield even shorter.

The following provides one exemplary embodiment of a method for polishing a surface of a work piece such as a semiconductor wafer in a CMP apparatus such as that illustrated in FIG. 1. In accordance with one embodiment of the invention a plurality of work pieces are conveyed to the CMP apparatus in a plurality of individual work piece caches 30 and these work piece caches are attached to front end module 24 of the CMP apparatus. The work pieces are preferably arrayed in a spaced apart manner in the work piece caches with the surfaces of the work pieces that are to be polished facing upwardly. A front end robot 32 removes a selected one of the work pieces from one of the work piece caches and transfers the work piece to a work piece hand off station 34. The front end robot transfers the work piece using an end effector 70 that preferably contacts only the peripheral edge portion of the back surface of the work piece. Likewise, preferably only the peripheral edge portion of the back surface of the work piece contacts the work piece hand off station. A transfer robot 36 having an end effector 74 on an extensible arm 75 grasps the work piece from the work piece hand off station and inverts the work piece so that the surface that is to be polished is facing downwardly. Preferably end effector 74 grasps only the edge of the work piece and does not contact an appreciable portion of the surface that is to be polished. The transfer robot places the work piece on a load cup (for example, load cup 52) of a selected one of the plurality of CMP systems 22 (for example CMP system 40) of the CMP apparatus. In a similar manner, transfer robot 36 could transfer the work piece to any one of the load cups associated with any of the CMP systems of the CMP apparatus. When the work piece is transferred to the load cup, the load cup is in its off-load position, pivoted away from its associated CMP system 40. The load cup then pivots about its axis to its load position aligned underneath work piece carrier head 48 of CMP system 40. The load cup is raised to cause the load cup and the work piece to contact the work piece carrier head and to transfer the work piece to the carrier head. The load cup is lowered and then pivots about its axis to its off-load position. The carrier head then is lowered to place the surface of the work piece that is to be polished in contact with polish pad 50 of CMP system 40. Slurry is delivered to the polish pad and relative motion is initiated between the carrier head and polish pad to accomplish the desired polishing of the surface of the work piece. When the desired amount of polishing has been accomplished, the relative motion and slurry delivery are stopped and the carrier head and hence the work piece are raised to a position out of contact with the polish pad. Load cup 52 then again pivots to a position underneath and aligned with the carrier head. The load cup is raised to contact the carrier head, and the work piece, now having a polished surface, is released from the carrier head to the load cup. In accordance with one embodiment of the invention, a fluid is sprayed from spray nozzles integral with the load cup onto the surface of the work piece. The fluid may contain surfactants or other chemicals to wet the surface of the work piece and to maintain that surface in a hydrophilic condition. The load cup and the processed work piece are lowered away from the carrier head and then are pivoted to the off-load position where the work piece is again grasped by end effector 74. Transfer robot 36 again inverts the now processed wafer so that the polished surface is upwardly facing and transfers the work piece to one of the plurality of cleaning stations 26. Instead of transferring the processed work piece to one of the cleaning stations, in accordance with a further embodiment of the invention, transfer robot could transfer the work piece, polished surface facing downwardly, to another of the plurality of CMP systems 22 for further processing such as polishing, buffing, or the like. In accordance with this embodiment of the invention, the work piece is subsequently transferred to one of the cleaning stations after the further processing is completed. Once transferred to the cleaning station, the work piece is cleaned, rinsed, and dried. After the work piece is dried, front end robot 32 removes the now processed, cleaned and dried work piece from the cleaning station and places it into one of the individual work piece caches 30. In accordance with one embodiment of the invention, a single front end robot 32 is able to remove a selected work piece from any one of a plurality of individual work piece caches 30 and to transfer that work piece to a work piece hand off station 34. That same robot is able to remove a processed work piece from any one of a plurality of cleaning stations 26 and to return the work piece to any one of the selected individual work piece caches. The front end robot and its associated end effector 70 come into contact only with cleaned work pieces, either those from the work piece caches or those from the cleaning stations. The single transfer robot 36 is able to transfer a work piece from the work piece hand off station 34 to any one of the plurality of CMP systems 22. That same transfer robot is able to transfer a processed work piece from any one of the CMP systems to any one of the plurality of cleaning stations 26.

While at least one exemplary embodiment has been presented in the foregoing detailed description, it should be appreciated that a vast number of variations exist. It should also be appreciated that the exemplary embodiments are only examples, and are not intended to limit the scope, applicability, or configuration of the invention in any way. Rather, the foregoing detailed description will provide those skilled in the art with a convenient road map for implementing the exemplary or other embodiments. It should be understood that various changes can be made in the function and arrangement of elements without departing from the scope of the invention as set forth in the appended claims and the legal equivalents thereof.

What is claimed is:

1. A chemical mechanical planarization (CMP) apparatus comprising:

a plurality of CMP stations, each of the plurality of CMP stations comprising a polish platen configured to support a polish pad and wherein at least two of the plurality of CMP stations have polish platens vertically offset from each other;

a plurality of load cups for loading unprocessed work pieces into and unloading processed work pieces from the plurality of CMP stations, each of the plurality of load cups configured to pivot between a load position and an off-load position and wherein at least one of the plurality of load cups overlies another of the plurality of load cups in the off-load position;

a plurality of cleaning stations for cleaning processed work pieces unloaded from the plurality of CMP stations; and a single robot configured to transfer unprocessed work pieces to the plurality of load cups and to transfer processed work pieces from the load cups to the plurality of cleaning stations.

2. The chemical mechanical planarization (CMP) apparatus of claim 1 wherein at least two of the plurality of load cups are vertically offset from each other in the off-load position.

3. The chemical mechanical planarization (CMP) apparatus of claim 1 wherein the plurality of CMP stations are arrayed in two spaced apart rows and the single robot is positioned between the two spaced apart rows.

4. The chemical mechanical planarization (CMP) apparatus of claim 3 wherein the single robot is configured to pivot about an axis to a raised position to allow access to the plurality of CMP stations.

5. The chemical mechanical planarization (CMP) apparatus of claim 3 further comprising a raised floor positioned between the two spaced apart rows and affording access to the plurality of CMP stations.

6. The chemical mechanical planarization (CMP) apparatus of claim 5 wherein the raised floor covers a chemical distribution system module for conveying chemicals to the plurality of CMP stations, the raised floor having a plurality of removable access covers.

7. The chemical mechanical planarization (CMP) apparatus of claim 3 further comprising an electrical cabinet positioned at an end of one of the two spaced apart rows, the electrical cabinet configured to have access doors on three sides.

8. The chemical mechanical planarization (CMP) apparatus of claim 1 further comprising a chemical drain coupled to at least one of the plurality of CMP stations to collect chemical effluent from the at least one of the plurality of CMP stations, the chemical drain coupled to an effluent separator.

9. The chemical mechanical planarization (CMP) apparatus of claim 8 wherein the effluent separator comprises a vertical chimney configured to separates liquids from gases in the chemical effluent.

10. The chemical mechanical planarization (CMP) apparatus of claim 9 wherein the vertical chimney comprises a divided vertical chimney having a liquid drain at a lower extremity of a first portion of the divided vertical chimney and a vapor exhaust at a lower extremity of a second portion of the divided vertical chimney.

11. A chemical mechanical planarization (CMP) apparatus comprising:

a plurality of CMP stations, each of the plurality of CMP stations comprising:

a wafer carrier head; and a polish platen wherein at least two of the plurality of CMP stations have polish platens vertically offset from each other; and a plurality of load cups for loading unprocessed work pieces into and unloading processed work pieces from the plurality of CMP stations, wherein each of the plurality of load cups is configured to pivot between a load position and an off-load position and wherein at least one of the plurality of load cups overlies another of the plurality of load cups in the off-load position.

* * * * *